US005197598A

United States Patent [19]

Stout et al.

[11] Patent Number: 5,197,598

[45] Date of Patent: Mar. 30, 1993

[54] ENCLOSED BOTTLE CARRIER

[75] Inventors: James T. Stout, Acworth; James B. DeMaio, Marietta, both of Ga.

[73] Assignee: The Mead Corporation, Dayton, Ohio

[21] Appl. No.: 922,571

[22] Filed: Jul. 30, 1992

[51] Int. Cl.[5] ..... B65D 65/12; B65D 5/02; B65D 5/44

[52] U.S. Cl. ..... 206/141; 206/427; 206/193

[58] Field of Search ..... 206/427, 434, 200, 193 X, 206/170, 174, 175, 162, 161, 147, 155, 141

[56] References Cited

U.S. PATENT DOCUMENTS

| | | | |
|---|---|---|---|
| 3,204,814 | 9/1965 | Mahon | 206/162 |
| 3,294,280 | 12/1966 | Graser | 206/155 |
| 4,007,830 | 2/1977 | Calvert | 206/175 |
| 4,715,493 | 12/1987 | Dreyfus | 206/200 |
| 4,804,089 | 2/1989 | Wilson | 206/161 X |
| 4,830,267 | 5/1989 | Wilson | 206/141 X |
| 4,925,019 | 5/1990 | Ganz et al. | 206/427 X |
| 5,020,668 | 6/1991 | Schuster | 206/427 |

*Primary Examiner*—Steven N. Meyers
*Assistant Examiner*—Jacob K. Ackun, Jr.
*Attorney, Agent, or Firm*—Rodgers & Rodgers

[57] ABSTRACT

A bottle carrier for packaging and gripping in a taut fashion a plurality of bottles includes top, bottom and side walls, each side wall having a substantially vertically disposed bottom portion and an inwardly inclined top portion foldably joined to the bottom portion to form a tubular structure, top end panels foldably joined to each end edge of the top wall together with a bottom end panel foldably joined to each end edge of the bottom wall and secured in overlapping relation with the associated top end panel. A first collapsible web is foldably joined to each end edge of each top end panel and to the end edge of each of the inwardly inclined top wall portion. A yieldable fold line formed in each collapsible web extends from the adjacent corner of the top wall downwardly in angular relation to the adjacent end edge of the associated inwardly inclined top wall portion.

8 Claims, 4 Drawing Sheets

ENCLOSED BOTTLE CARRIER

TECHNICAL FIELD

This invention relates to carriers for packaging which are specially designed to prevent bottle breakage due to collision between adjacent bottles.

BACKGROUND ART

U. S. Pat. No. 3,904,036 issued Sep. 9, 1975 and owned by the assignee of this invention discloses a fully enclosed bottle container and includes a so called false score formed in the bottom wall.

Canadian patent 1,166,211 owned by the assignee of this invention discloses a carton for beverage containers which is similar in some respects to this invention.

SUMMARY OF THE INVENTION

This invention in one form provides an enclosed bottle carrier having top, bottom and side walls wherein each side wall includes a bottom portion and an inwardly inclined top portion, said top, bottom and side walls being interconnected to form a tubular structure, a top end panel foldably joined to each end edge of said top wall, collapsible web structure foldably joined to each end edge of each of said top end panels and to the end edge of each of said inwardly inclined top wall portions, each of said collapsible webs having a yieldable fold line extending from the adjacent corner of said top wall and disposed in angular relation to the adjacent end edge of each of said inwardly inclined top wall portions so as to grip the necks of the corner bottles in a taut fashion and a bottom end panel foldably joined to each end edge of said bottom wall and secured in overlapping relation with the associated top end panel.

BEST MODE OF CARRYING OUT THE INVENTION

Figure 1:
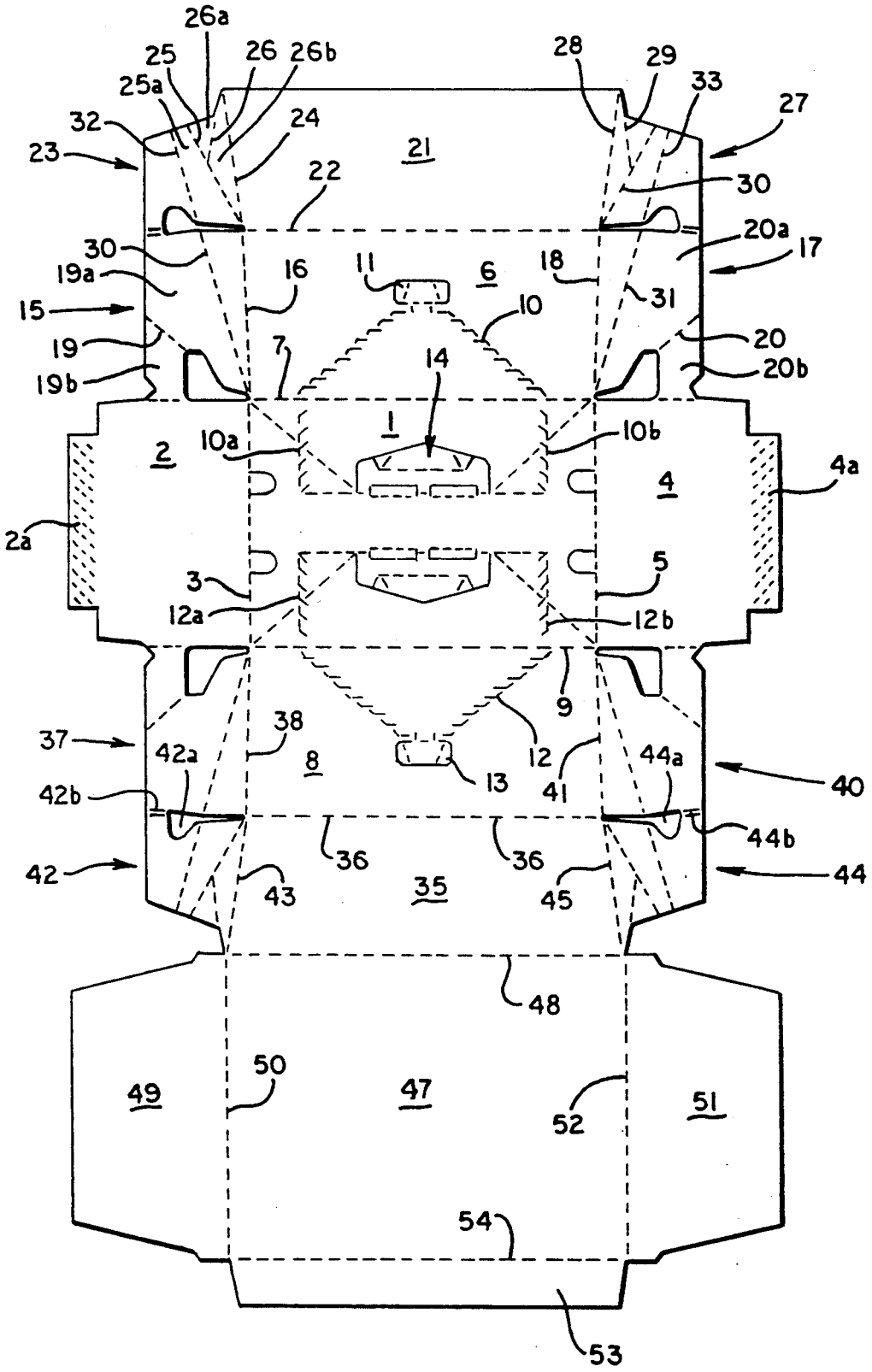
FIG. 1 is a plan view taken from the inside of a blank formed according to this invention.

With reference to FIG. 1, the top wall of the carrier is designated by the numeral 1. Top end panel which is designated by the numeral 2 is foldably joined to top wall 1 along fold line 3 and top end panel 4 is foldably joined to top wall 1 along fold line 5. Side wall top portion is designated by the numeral 6 and is foldably joined to top wall 1 along fold line 7. On the other side of the carrier, top side wall portion 8 is foldably joined to top wall 1 along fold line 9. Tear strip 10 having a finger gripping pull tab 11 is formed in side wall 6 and extends into top wall 1 as indicated at 10*a* and 10*b*. On the other side of the carrier, tear line 12 and pull tab 13 are formed in the upper side wall element 8 and extend into the top wall as designated at 12*a* and 12*b*. Hand gripping handle is formed in top wall 1 and designated generally at 14.

Collapsible web structure 15 is foldably joined to the upper side wall panel 6 along fold line 16 and similar collapsible web structure 17 is foldably joined to the upper inwardly inclined side wall panel 6 along fold line 18. Collapsible web structure 15 is formed with a fold line 19 along which parts 19*a* and 19*b* are foldable when the structure 15 is collapsed during set up of the carrier. In similar fashion, collapsible web structure 17 includes a fold line 20 along which panels 20*a* and 20*b* are foldable into flat face contacting relation when the carrier is set up.

Side wall bottom portion is designated at 21 and is foldably joined to inwardly inclined side wall 6 along fold line 22. Web structure 23 is foldably joined to side wall bottom portion 21 along fold line 24. Web structure 23 includes weakened lines 25 and 26 which facilitate manipulation of panel elements 25*a*, 26*a* and 26*b* which aid in gripping the bottles and tend to prevent breakage.

In like fashion, web structure 27 is foldably joined to side wall bottom portion 21 along fold line 28 and includes weakened lines 29, 30 and 33 which facilitate gripping of bottles in a taut fashion.

According to one feature of this invention, a weakened fold line 30 is formed in collapsible web structure 15 and a yieldable fold line 31 is formed in collapsible web structure 17 as shown in FIG. 1.

According to another feature of this invention, the yieldable fold line 30 is extended into the collapsible structure 23 along a fold line 32 which is coaxially disposed relative to fold line 30. In like fashion, a yieldable fold line 33 is formed in collapsible structure 27. Yieldable fold line 32 is coaxially disposed with respect to yieldable fold line 30 and yieldable fold line 33 is coaxially disposed relative to yieldable fold line 31. These yieldable fold lines 30, 32, 31 and 33 constitute an improvement whereby bottles packaged within the container are securely gripped so as to hold the bottles in a taut and secure condition.

On the other side of the carrier, a side wall bottom portion is designated by the numeral 35 and is foldably joined to the top inwardly inclined side wall portion 8 along fold line 36. Collapsible web structure generally designated at 37 is formed and foldably joined to one end 38 of inwardly inclined top wall portion 8. In like fashion, collapsible web structure 40 is foldably joined to the opposite end of inwardly inclined side wall panel 8 along fold line 41. Collapsible web structures 37 and 40 are formed in the same manner as are the collapsible structures 15 and 17 previously described.

Also a web structure generally designated at 42 is foldably joined to bottom side wall portion 35 along fold line 43 and is formed in a manner identical to the manner in which collapsible structure 15 is formed. Web structure 42 is partially separated from collapsible web structure 37 by a slot 42*a* and is interconnected therewith by a small rectangular panel 42*b*. In like fashion, web structure 44 is foldably joined to bottom side wall portion 35 along fold line 45 and collapsible structure 44 is identical to side wall structure 27 previously described. Web structure 44 is partially separated from collapsible web structure 40 by a slot 44*a* and is interconnected therewith by a small rectangular panel 44*b*.

Bottom wall 47 is foldably joined to the bottom side wall portion 35 along fold line 48 and bottom end panel 49 is foldably joined to bottom wall 47 along fold line 50. In like fashion, bottom end panel 51 is foldably joined to bottom wall panel 47 along fold line 52. A glue flap 53 is foldably joined to an edge of bottom wall 47 along fold line 54.

Figure 2:
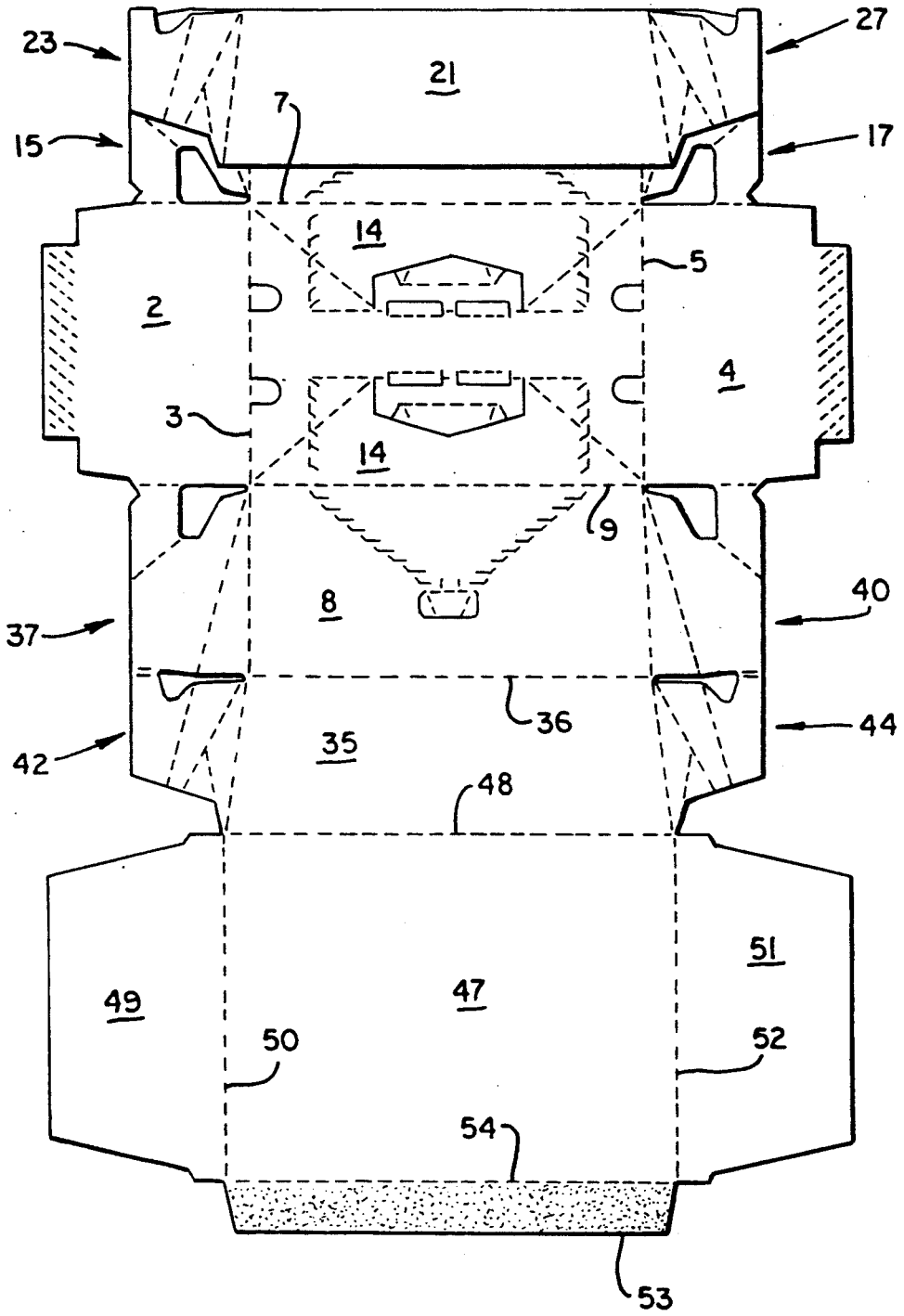
FIGS. 2 and 3 show stages of folding through which the blank of FIG. 1 is manipulated so as to form a complete set up and closed carrier as shown in FIG. 4.

In order to manipulate the blank of FIG. 1 into the condition shown in FIG. 2, side wall bottom portion 21 is simply elevated and folded forwardly along fold line 22 and web structures 23 and 27 are from their positions shown in FIG. 1 to the position shown in FIG. 2.

Figure 3:
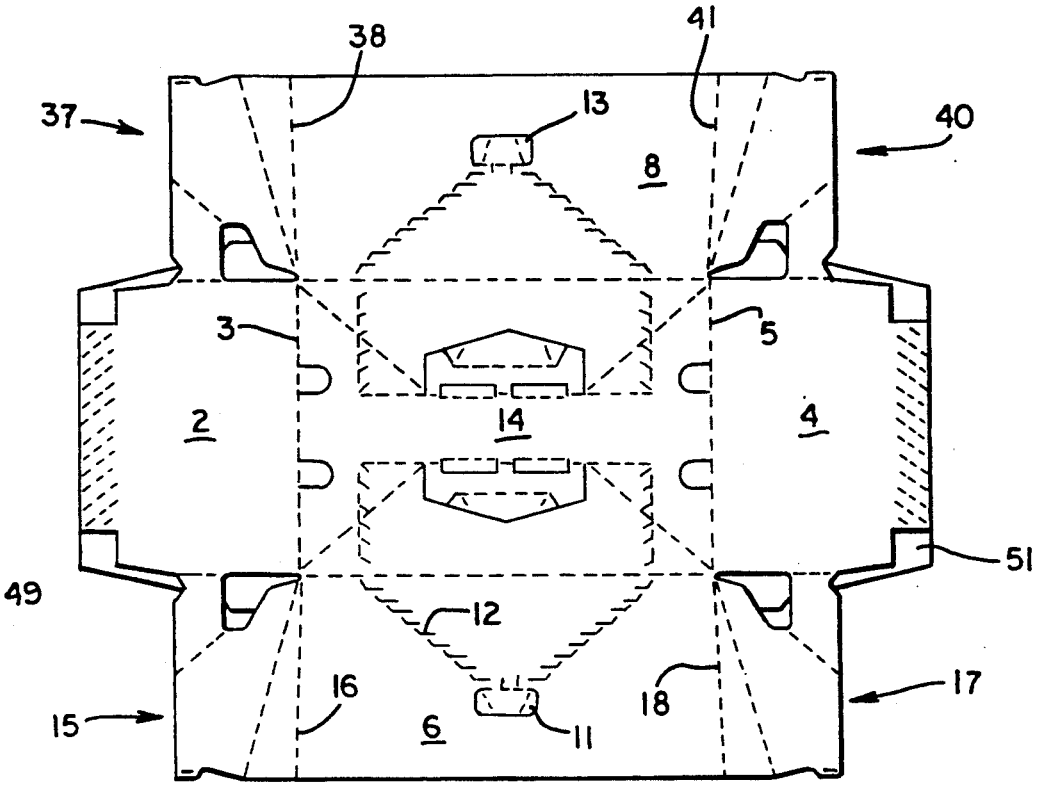

The carton as shown in FIG. 2 is manipulated into the collapsed condition shown in FIG. 3 by simply elevating the lower side wall 6, the handle 14 and side wall 8 along with wall panel 21 and folding downwardly along the fold line 36 following the application of glue to glue flap 53. This folding operation causes the web structure 37 and 40 as well as the web structure 15 and 17 to overly their associated webs 42 and 44 and 23 and 27.

Figure 4:
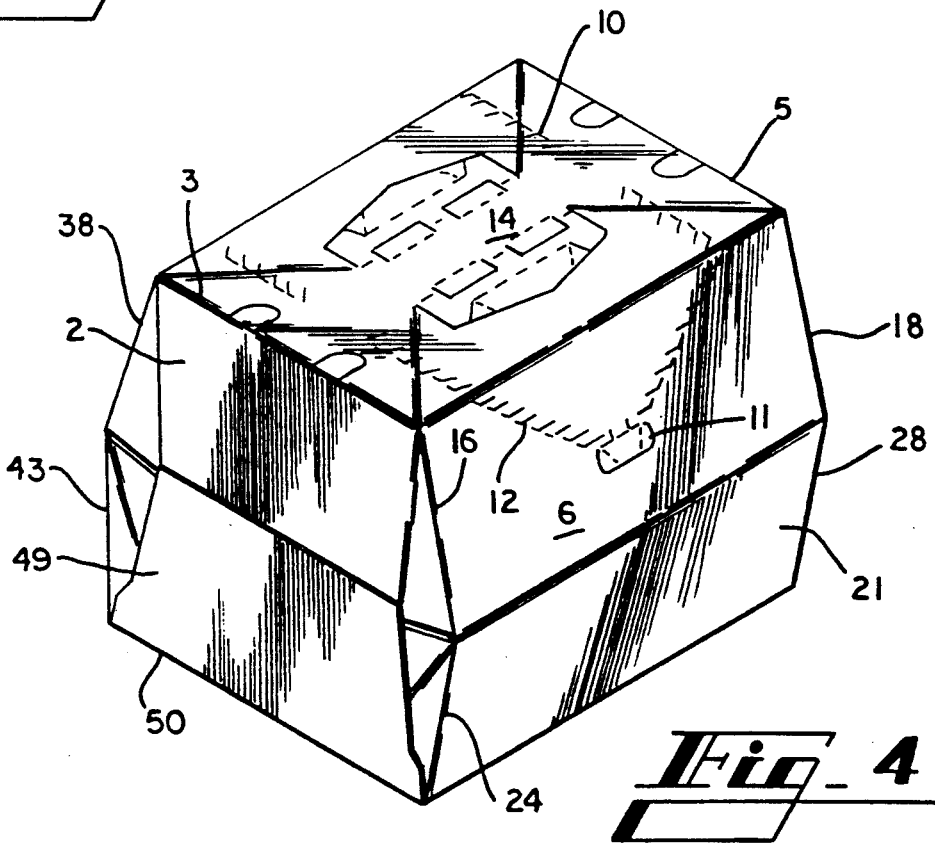
Figure 5:
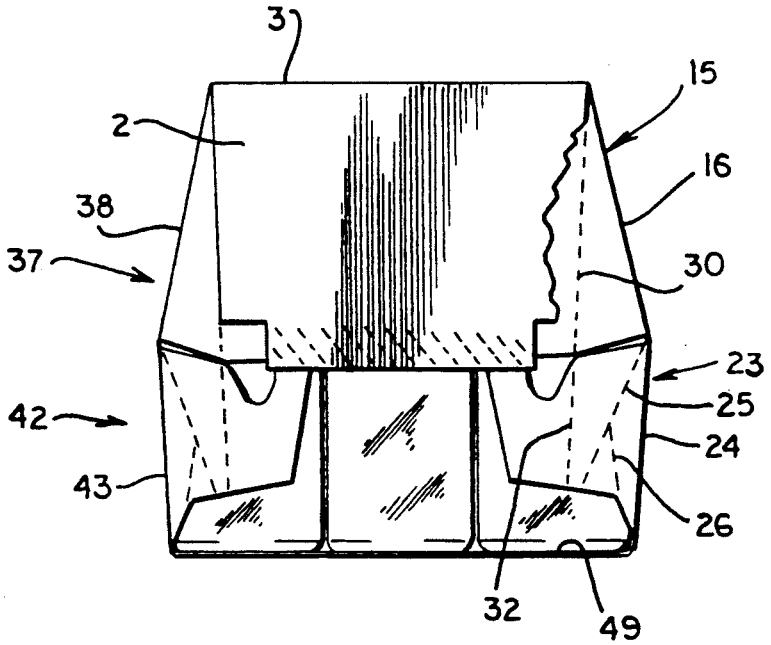
FIG. 5 shows the carton partially closed and with areas broken away.
Figure 6:
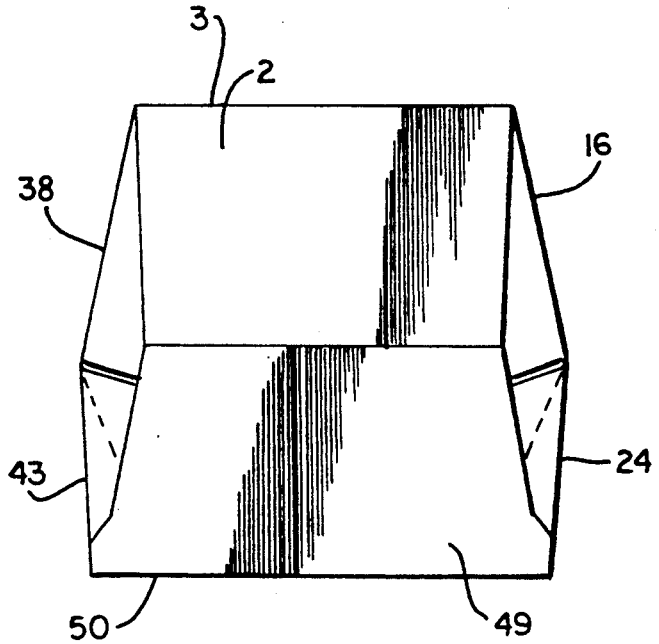
FIG. 6 shows the carton from one end which is fully enclosed.

In order to set the carrier up from its collapsed condition as shown in FIG. 3 into its fully completed condition as shown in FIG. 4, the top wall 14 is elevated so that the bottom side wall panels 21 and 35 are substantially vertically disposed relative to the bottom wall 47. Following loading of the bottles into the carrier, from one or both ends, the structures 15, 23, 17, 27, 37, 42, 40 and 44 are swung inwardly into set up condition. The top end panels 2 and 4 are swung downwardly along the fold lines 3 and 5 respectively while the bottom end panels 49 and 51 are folded along fold lines 50 and 52 to cause the adhesive 2*a* on top end panel 2 and the adhesive 4*a* formed in top end panel 4 to become adhered to the outer edges of bottom end panels 49 and 51 and the fully loaded and set up carton appears as shown in FIG. 4. FIG. 5 shows the carrier from one end with parts broken away so as to show weakened lines 30, 32, 25 and 26.

We claim:

1. A bottle carrier comprising top, bottom, and side walls, each side wall having a bottom portion and an inwardly inclined top portion, said top, bottom and side walls being interconnected to form a tubular structure, said top wall being rectangular, a top end panel foldably joined to each end edge of said top wall, a web structure foldably joined to each end edge of each of said top end panels and to an adjacent end edge of each of said inwardly inclined top wall portions, each of said webs structures having a yieldable fold line extending from an adjacent corner of said top wall and disposed in angular relation to the adjacent end edge of the associated inwardly inclined top wall portion so as to grip the necks of the corner bottles in a taut fashion, and a bottom end panel foldably joined to each end edge of said bottom wall and secured in overlapping relation with the associated top end panel.

2. A bottle carrier according to claim 1 wherein a second web is foldably joined to an end edge of each of said side wall bottom portions.

3. A bottle carrier according to claim 2 wherein each said second web is partially separated by a slot from said first web and interconnected therewith by a small rectangular panel.

4. A bottle carrier according to claim 2 wherein a first yieldable fold line is formed in each of said second webs and disposed in coaxial relation with said yieldable fold line in said first webs.

5. A bottle carrier according to claim 2 wherein each of said bottom end panels is secured to the adjacent second webs by adhesive.

6. A bottler carrier according to claim 4 wherein a second yieldable fold line is formed in each of said second webs and extends from an upper corner of each of said side wall bottom portions downwardly and in converging relation to each of said first yieldable fold lines.

7. A bottle carrier according to claim 6 wherein a third yieldable fold line is formed in each of said second webs and extends from a lower outer corner of each of said second webs upwardly and inwardly to a point of intersection with the associated one of said second yieldable fold lines to aid in gripping the body portion of the corner bottles in the carrier in a taut and stable fashion.

8. A bottle carrier according to claim 1 wherein each of said web structures is collapsible along a fold line which extends from an outer edge thereof toward the adjacent top corner of the carrier.

* * * * *